US007237812B2

(12) United States Patent
Tweedy

(10) Patent No.: US 7,237,812 B2
(45) Date of Patent: Jul. 3, 2007

(54) PADDLE HANDLE LATCH RELEASE DEVICE AND SPRING LATCH SYSTEM USING SAME

(75) Inventor: Timothy Tweedy, Elkhart, IN (US)

(73) Assignee: Fastec Industrial Corp., Elkhart, IN (US)

( * ) Notice: Subject to any disclaimer, the term of this patent is extended or adjusted under 35 U.S.C. 154(b) by 0 days.

(21) Appl. No.: 11/144,678

(22) Filed: Jun. 6, 2005

(65) Prior Publication Data

US 2006/0279094 A1 Dec. 14, 2006

(51) Int. Cl.
*E05C 1/06* (2006.01)

(52) U.S. Cl. ..... 292/40; 292/336.3; 292/DIG. 31

(58) Field of Classification Search ..... 292/40, 292/336.3 X, 29, 7, DIG. 31 X, 33–36, 41; 70/208, 472
See application file for complete search history.

(56) References Cited

U.S. PATENT DOCUMENTS 2,349,192 A 5/1944 Oxhandler
2,486,586 A 11/1949 Brittain et al.
4,170,119 A * 10/1979 Kalis, Jr. ..... 70/221
5,299,844 A * 4/1994 Gleason ..... 292/240
5,586,458 A * 12/1996 Weinerman et al. ..... 70/208
5,586,795 A * 12/1996 Sasaki ..... 292/336.3
5,820,174 A * 10/1998 Parikh et al. ..... 292/126
5,884,948 A * 3/1999 Weinerman et al. ..... 292/216
6,349,577 B1 * 2/2002 Hansen et al. ..... 70/159
6,490,895 B1 * 12/2002 Weinerman et al. ..... 70/208
6,695,361 B1 * 2/2004 Gleason et al. ..... 292/216
6,758,503 B2 * 7/2004 Sadler ..... 292/35

* cited by examiner

*Primary Examiner*—Brian E. Glessner
*Assistant Examiner*—Mark Williams
(74) *Attorney, Agent, or Firm*—Dykema Gossett PLLC

(57) ABSTRACT

A paddle handle latch release device of a spring latch system includes a paddle handle member pivotally mounted in a pan housing, the paddle handle member including an actuating lever which extends below a floor of the pan housing; a spider member rotatably mounted to the underside of the floor, the spider member including latch arms extending from a hub and an operating arm in contact with the actuating lever; and a torsion spring which biases the operating arm against the actuating lever; the spider being rotated from an inactive positioning by the actuating lever when the paddle handle member is manually rotated from a lowered positioning to a lifted positioning, and the torsion spring returning the spider member to an inactive positioning and the paddle handle member back to a lowered positioning when the paddle handle member is released.

11 Claims, 4 Drawing Sheets

PADDLE HANDLE LATCH RELEASE DEVICE AND SPRING LATCH SYSTEM USING SAME

BACKGROUND OF THE INVENTION

1. Field of the Invention

The present invention relates to spring latch systems which include one or more spring latches to releasably connect one member to another member, such as a door to or within a door frame, and to latch release devices used in such systems.

2. The Prior Art

Spring latch systems for releasably connecting two members together, such as a door or other types of closure member to or within a frame member, are very well known. Such systems include one or more spring latches and a release device for unlocking (opening) the spring latches when it is desired to separate the connected members. Various types of spring latches and various types of release devices have been devised. Many are too complicated in construction or expensive to produce for common usage, or are prone to early failure.

SUMMARY OF THE INVENTION

According to my invention, a spring latch system includes at least one spring latch and a paddle handle latch release device for opening the spring latches, the paddle handle latch release device including a pan housing; a paddle handle grip member which is pivotably mounted within the pan housing, the grip member including an actuating lever that extends below a floor of the pan housing; a spider member which is rotatably mounted beneath the floor of the pan housing and includes a hub, a plurality of latch arms which extend from the hub, and an operating arm that extends from the hub between two latch arms to be contacted by the actuating lever; and a torsion spring which has one end in contact with the spider member and an opposite end fixedly positioned on the underside of the floor of the pan housing to bias the spider member against the actuating lever. Manual pivotal movement of the grip member from a lowered positioning to a lifted positioning relative to the pan housing will, by way of the actuating lever being in contact with the operating arm, cause the spider member to rotate against the bias of the torsion spring from an inactive positioning to an active positioning. This in turn will move connection members that are respectively connected to the latch arms and to respective spring latches to open the spring latches. When the grip member is released, the torsion spring will cause the spider member to rotate back to its inactive positioning and, by way of the operating arm being in contact with the actuating lever, the grip member to return to its lowered positioning. No other spring member is needed to rotate the grip member back to its lowered positioning The invention will now be better understood by reference to the attached drawings, taken in conjunction with the following discussion.

DETAILED DESCRIPTION OF THE PREFERRED EMBODIMENTS

Figures 1, 2, 3, 4:
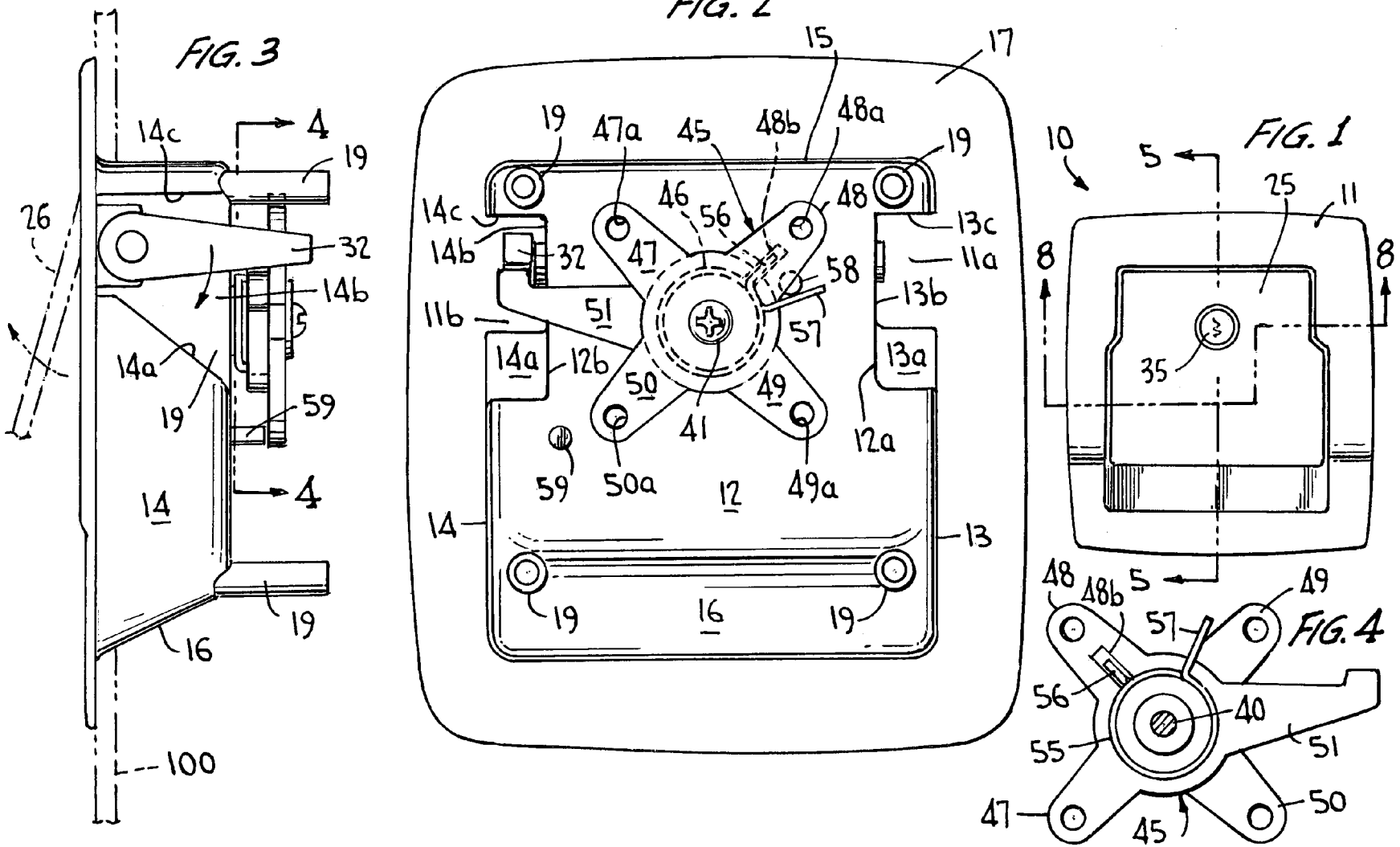
FIG. 1 is a front view of a paddle handle latch release device constructed according to a preferred embodiment of the present invention, its paddle handle member being seen within the rim of its pan housing and mounting a cylinder lock therein.
FIG. 2 is an enlarged rear view of the paddle handle latch release device of FIG. 1, its spider member and biasing torsion spring being shown in an inactive positioning.
FIG. 3 is a right side view of the paddle handle latch release device of FIG. 1 but on the same larger scale as in FIG. 2, the operative interaction between the actuating lever of the paddle handle member and the operating arm of the spider member being depicted.
FIG. 4 is a view of the spider member and biasing torsion spring as seen along line 4—4 in FIG. 3.

A paddle handle latch release device according to a preferred embodiment of the present invention is generally labeled 10 in FIG. 1. It includes a pan housing 11 and a paddle handle member 25 which is mounted in the pan housing. A key-operated cylinder lock 35 is mounted in the paddle handle member.

As best seen in FIGS. 2, 3, 5 and 8, the pan housing 11 includes a floor 12, a left side wall 13, a right side wall 14, an upper end wall 15, a lower end wall 16 and a rim 17. The floor 12 is generally rectangular except for generally rectangular cut-out areas 12*a* and 12*b* on opposite sides thereof near the upper end wall 15. The left side wall 13 includes side segments 13*a*, 13*b*, and 13*c* which extend from the floor 12 to the rim 17, and the right side wall 14 includes side segments 14*a*, 14*b* and 14*c* which extend from floor 12 to the rim 17. It can be seen from FIGS. 2 and 3 that side segments 13*a* and 14*a* are sloped between the floor 12 and the rim 17, as is the lower end wall 16. The cut-out areas 12*a* and 12*b* and the side segments 13*a*–13*c* and 14*a*–14*c* provide side channels 11*a* and 11*b*. The side segments 13*b* and 14*b* include aligned bearing holes 13*d* and 14*d* (see FIG. 8). The pan housing fits in an opening in the closure member 100 so that its rim 17 contacts a front face of the closure member.

Mounting posts 19 extend (perpendicularly) away from the respective four corners of the floor 12 so as to enable the paddle handle latch release device 10 to be fixedly mounted relative to the closure member 100, i.e., using screws that extend into free ends thereof to attach an abutment plate against a rear face of the closure member (not shown).

The paddle handle member 25 includes a generally flat grip member 26 having spaced mounting brackets 26*a* and 26*b* on its underside (the side opposite that shown in FIG. 1). A shaft 27 having a head 28 extends inwardly through the bearing hole 13*d* in the side segment 13*b* of pan housing 13 and through an aligned channel in the mounting bracket 26*a*, and is fixed in place by a collar 29 that is positioned around the inside end of the shaft 27 by a roll pin 30. The collar 29 has a square external cross section that extends into a square seat (not shown) formed in the inside surface of the bracket 26*a*. A shaft 31 extends through the bearing hole 14*d* in the side segment 14*b* and through an aligned channel in the mounting bracket 26*b*. An actuating lever 32 is fixedly attached to the outside end of the shaft 31. The actuating lever 32 extends downwardly through the side channel 11*b* to a free end located beyond (below) the floor 13. A collar 33 is attached to the inside end of the shaft 31 by a roll in pin 34. The collar 33 has a square external cross section that extends into a square seat (not shown) formed in the inside surface of the bracket 26*b*. When the grip member 26 is lifted (see FIGS. 3 and 5), the shaft 27 will rotate relative to the bearing hole 13*d* and the shaft 31 (and operating lever 32) will rotate relative to the bearing hole 14*d*.

Figure 6:
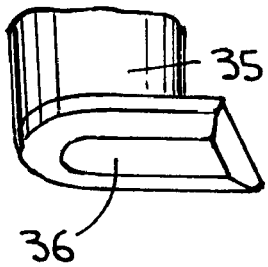
FIGS. 6 and 7 illustrate the orientation of the lock arm of the cylinder lock in the paddle handle member when in a locking state (FIG. 6) and an unlocking state (FIG. 7), FIG. 8. is an enlarged cross sectional view of the paddle handle latch release device as seen along line 8—8 in FIG. 1, the lock arm of the cylinder lock in the paddle handle being in an unlocking state.
Figure 7:
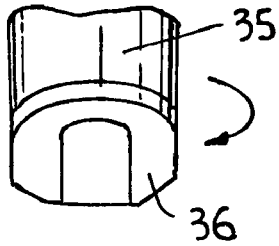
Figure 8:
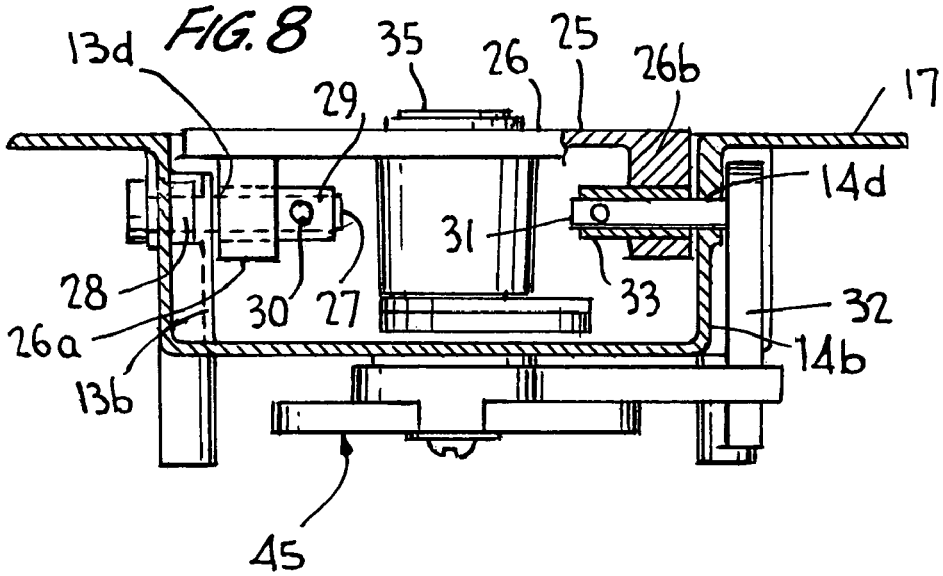

The key operated cylinder lock 35 is mounted in the grip member 26 between the brackets 26*a* and 26*b*. It includes a lock arm 36 that can be rotated between a locking orientation (FIG. 6) where it abuts the pan housing floor 12 when the paddle handle member 26 is attempted to be lifted, thus preventing rotation of the paddle handle member about the bearing holes 13*d* and 14*d* (FIG. 6), and an unlocking orientation (FIG. 7) where it will not abut the pan housing floor 12 when the paddle handle member is lifted, thus allowing lifting.

Figure 5:
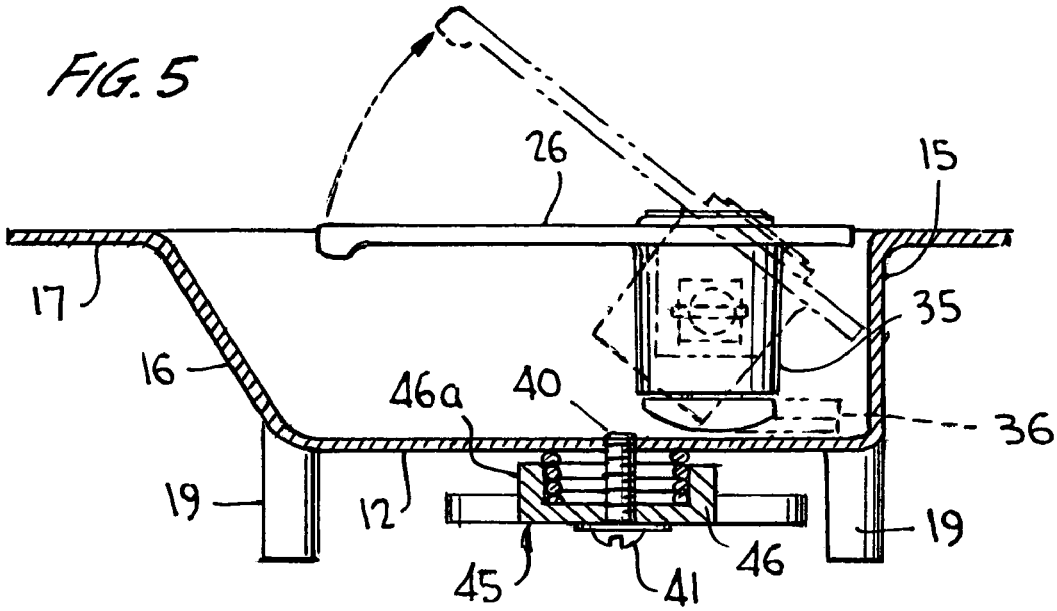
FIG. 5 is an enlarged cross sectional view of the paddle handle latch release device as seen along line 5—5 in FIG. 1, the inactive positioning of the paddle handle member being shown in solid lines and the active positioning being shown in phantom.

As best seen in FIGS. 2, 4 and 5, a bearing shaft 40 extends downwardly from the pan housing floor 12, and a spider member 45 is rotationally mounted thereon by a screw 41. The spider member includes a hub 46, four equispaced latch arms 47–50 extending radially away from the hub, and a operating arm 51 which extends away from the hub between latch arms 47 and 50. The latch arms extend the same radial distance from the hub 46 whereas the operating arm 51 extends a further distance from the hub. The end of operating arm 51 is in contact with the free end of actuating lever 32 (see FIGS. 2 and 3). The hub 46 defines a cylindrical chamber 46*a* which contains a torsion spring 55 having a first end 56 extending into a slot 48*a* in arm 48, and a second end 57 fixedly positioned relative to the floor 13 by contact against an abutment nub 58 extending downwardly from the floor 13. The torsion spring 55 applies a constant rotational bias to the spider member 45 to maintain operating arm 51 in contact with the actuating lever 32. When the grip member 26 is manually rotated from its lowered positioning to its lifted positioning, the actuating arm 32 will, by contact with the operating arm 32, cause the spider member 45 to rotate against the bias of torsion spring 55 from its inactive positioning to its active positioning; however, when the grip member 26 is released, the torsion spring will cause the spider member to return to its inactive positioning and, via the actuating arm 32, the grip member to return to its lowered positioning. A stop pin 59 extends downwardly from the floor 13 to limit rotation of the operating arm 51 prior to the actuating lever contacting the side wall segment 14*a*. The stop pin 59 prevents binding of the spider member 45. The radial latch arms 47–50 include respective openings 47*a*, 48*a*, 49*a* and 50*a* at their free ends for attachment of connecting members (see FIGS. 9–11).

Figure 9:
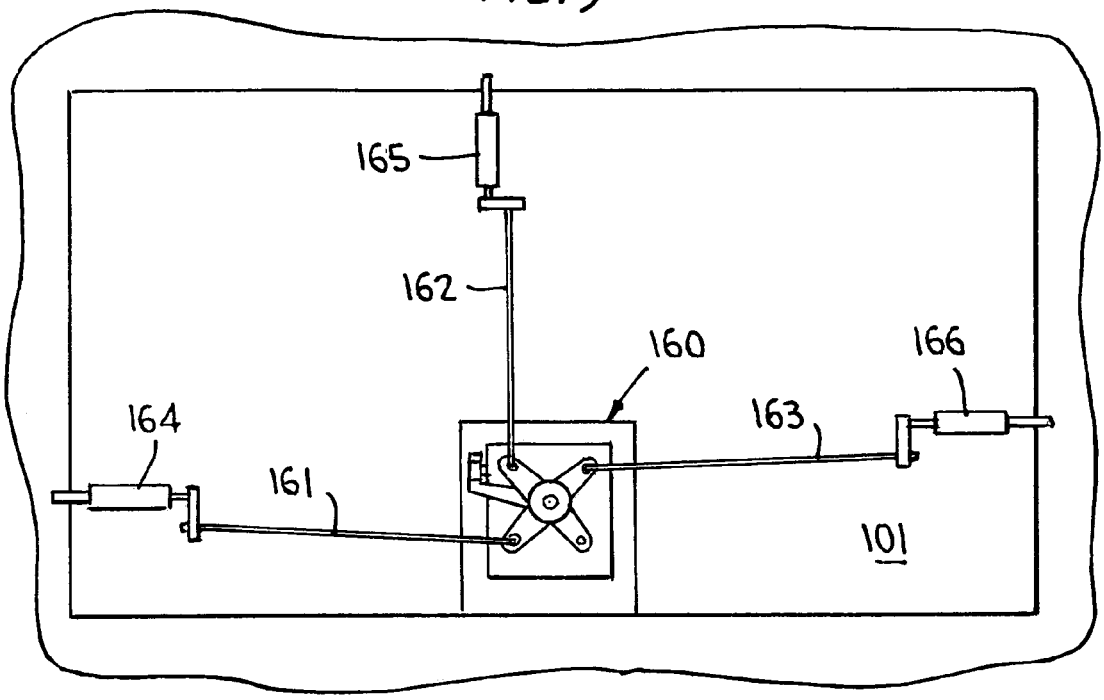
FIGS. 9 and 10 are schematic views of a spring latch assembly according to a first embodiment of the present invention, the spring latch assembly including a paddle handle latch release device according to the invention connected with three spring latches located at three respective sides of a rectangular closure member, FIG. 9 showing a paddle handle latch release device in an inactive state (its paddle handle member being in an inactive positioning) and the three spring latches not retracted, thus preventing the closure member from being opened, and FIG. 10 showing the paddle handle release device in an active state (its paddle handle member in an active positioning) and the three spring latches retracted, thus enabling the closure member to be opened.
Figure 10:
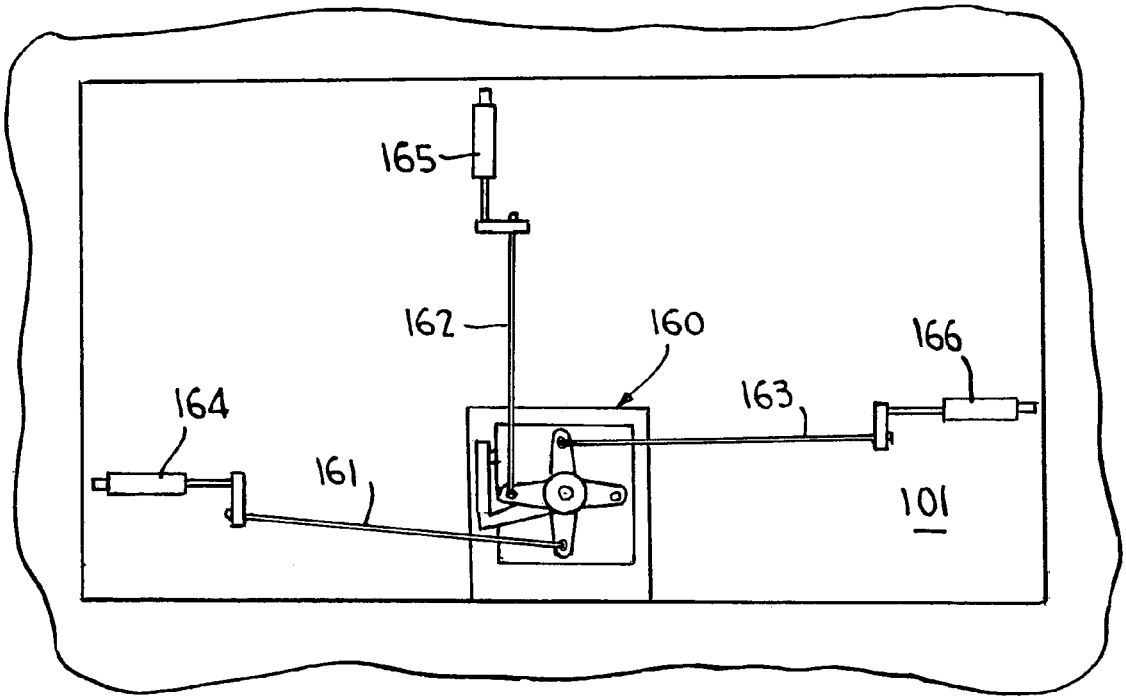

Turning now to FIGS. 9 and 10, an embodiment of spring latch system 150 is shown wherein the paddle handle latch release device 160, which is mounted on closure member 101, is connected by connection means 161, 162 and 163 to separate spring latches 164, 165 and 166 located at three sides of a generally rectangular closure member 100 to open them when the paddle handle latch release device is actuated by lifting of the grip member of its paddle handle member. In this way, closure member 100 can be released and moved relative to a surrounding structure. The connection means 161–163 can be rods, cables or other interconnecting elements.

Figure 11:
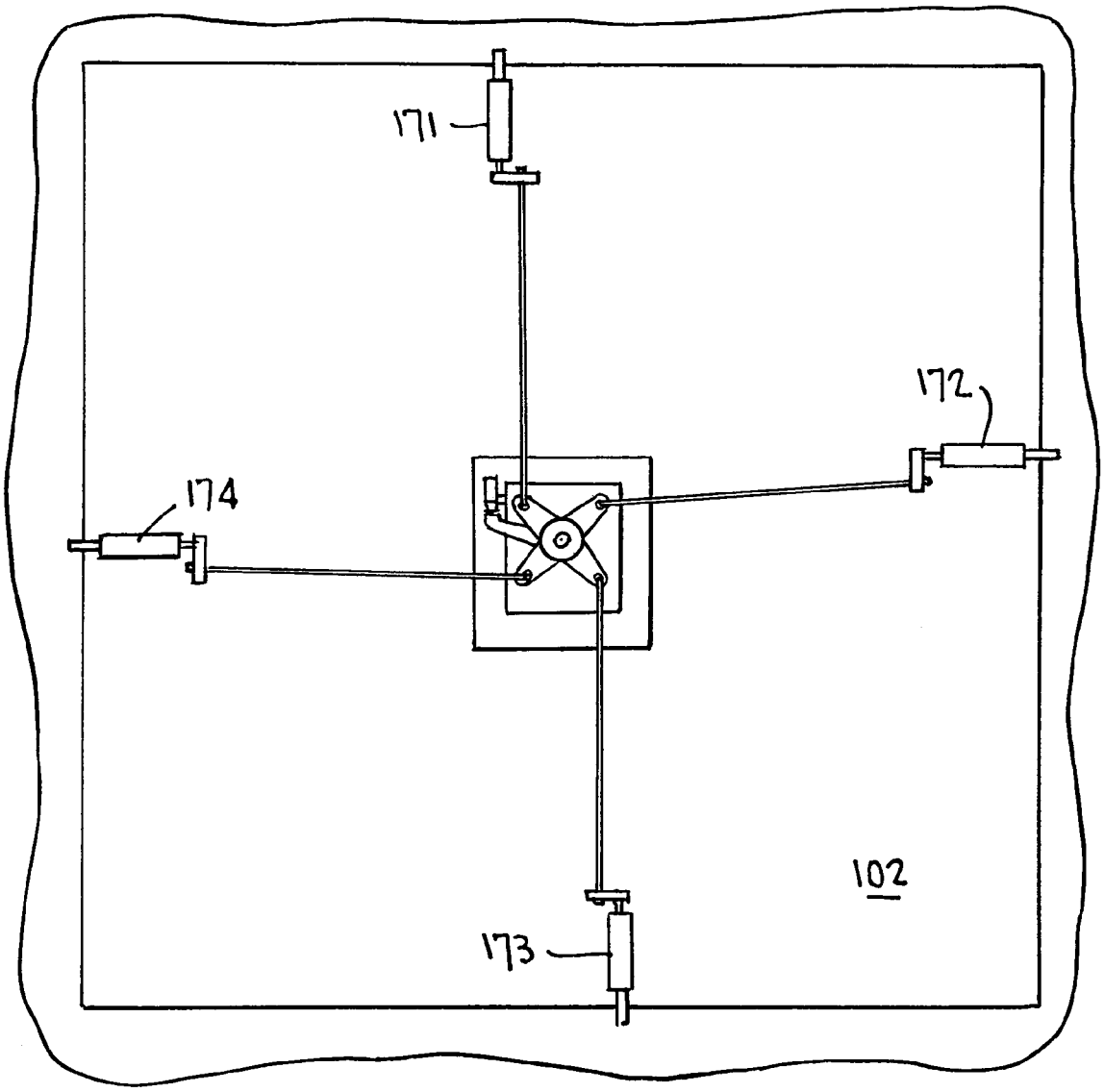
FIG. 11 shows a second embodiment of a spring latch assembly according to this invention wherein the paddle handle latch release device is connected with four spring latches located at four respective sides of a rectangular closure member.

FIG. 11 shows another embodiment of spring latch system 170 wherein the paddle handle latch release device is connected to four spring latches 171, 172, 173 and 174 located at four sides of a generally rectangular closure member 102 using four separate connection means.

Although the invention has now been explained in detail with respect to various embodiments, modifications therein can be made and still fall within the scope of the appended claims. For example, the spring latch system can include only two spring latches or more than four depending of the application. And the paddle handle latch release device can include two, three, or more than four latch arms.

I claim:

1. A paddle handle latch release device which comprises:

a pan housing that defines a floor, a left side wall, a right side wall, an upper end wall, a lower end wall and a rim, said left and right side walls providing aligned bearing holes and a bearing shaft that extends downwardly from the floor, a paddle handle member which is pivotally mounted to said pan housing, said paddle handle member including a grip member which is positioned between said left and right side walls, said grip member including a mounting bracket extending away from an underside thereof; a shaft which extends through said mounting bracket and one of said bearing holes; and an actuating lever which is connected to said shaft and which extends downwardly below said floor, said actuating lever rotating when said grip member is rotated relative to said one bearing hole, and a spider member rotatably mounted on said bearing shaft, said spider member including a hub having an internal chamber which faces said floor, a plurality of latch arms extending away from said hub, and an operating arm extending away from the hub so as to be in contact with said actuating lever, and a torsion spring positioned in said internal chamber of said hub and which has one end in contact with said spider member and an opposite end fixed relative to the pan housing floor, said torsion spring biasing said operating arm of said spider member against said actuating lever of said paddle handle member.

2. A paddle handle latch release device according to claim 1, including a key-operated cylinder lock mounted in said grip member, said cylinder lock including a lock arm which, depending on its orientation relative to the side walls of the pan housing, will prevent or enable rotation of said grip member.

3. A paddle handle latch release device according to claim 1 wherein said latch arms extend radially away from said hub.

4. A paddle handle latch release device according to claim 1, wherein said one end of said torsion spring extends within a slot in one of said plurality of latch arms.

5. A paddle handle latch release device according to claim 1, including an abutment nub which extends downwardly from the floor of said pan housing, and wherein said opposite end of said torsion spring abuts said abutment nub.

6. A spring latch assembly which includes a plurality of spring latches for preventing one member from moving relative to another member, a paddle handle latch release device according to claim 1, and respective connection means extending between respective latch arms of the spider member of said paddle handle latch release device and each of said plurality of spring latches to release said spring latches upon rotation of said spider member due to pivoting movement of said grip member.

7. A spring latch assembly according to claim 6, including three spring latches respectively connected to three latch arms of said spider member.

8. A spring latch system according to claim 7, including four spring latches respectively connected to four latch arms of said spider member.

9. A paddle handle latch release device which comprises:

a pan housing that defines a floor, a left side wall, a right side wall, an upper end wall, a lower end wall and a rim, said left and right side walls providing aligned bearing holes and a bearing shaft that extends downwardly from the floor, a paddle handle member which is pivotally mounted to said pan housing, said paddle handle member including a grip member which is positioned between said left and right side walls, said grip member including first and second spaced mounting brackets extending away from an underside thereof, a first shaft which extends through the first mounting bracket and through a bearing hole in one of said left and right side walls, and a second shaft which extends through the second mounting bracket and through a bearing hole in the second of said left and right side walls, and an actuating lever which is fixedly connected to an end of said second shaft outside of said second wall and which extends downwardly below said floor, said actuating lever rotating when said grip member is rotated relative to said bearing holes, and a spider member rotatably mounted on said bearing shaft, said spider member including a hub, a plurality of latch arms extending away from said hub, and an operating arm extending away from the hub so as to be in contact with said actuating lever, and a torsion spring having one end in contact with said spider member and an opposite end fixed relative to the pan housing floor, said torsion spring biasing said operating arm of said spider member against said actuating lever of said paddle handle member.

10. A paddle handle latch release device which comprises:

a pan housing that defines a floor, a left side wall, a right side wall, an upper end wall, a lower end wall and a rim, said left and right side walls providing aligned bearing holes, a bearing shaft that extends downwardly from the floor and a stop pin which extends downwardly from said pan housing, a paddle handle member which is pivotally mounted to said pan housing, said paddle handle member including a grip member which is positioned between said left and right side walls, said grip member including a mounting bracket extending away from an underside thereof; a shaft which extends through said mounting bracket and one of said bearing holes; and an actuating lever connected to said shaft which extends downwardly below said floor, said actuating lever rotating when said grip member is rotated relative to said one bearing hole, and a spider member rotatably mounted on said bearing shaft, said spider member including a hub, a plurality of latch arms extending away from said hub, and an operating arm extending away from the hub so as to be in contact with said actuating lever, said latch arms extending an equivalent distance from said hub and said operating arm extending a greater distance from said hub than said latch arms, movement of said operating arm being limited by said stop pin, and a torsion spring having one end in contact with said spider member and an opposite end fixed relative to the pan housing floor, said torsion spring biasing said operating arm of said spider member against said actuating lever of said paddle handle member.

11. A paddle handle latch release device which comprises:

a pan housing that defines a floor, a left side wall, a right side wall, an upper end wall, a lower end wall and a rim, said left and right side walls providing aligned bearing holes and a bearing shaft that extends downwardly from the floor, said left and right side walls of said pan housing defining cut-out areas near said upper end wall which define left and right side channels, a paddle handle member which is pivotally mounted to said pan housing, said paddle handle member including a grip member which is positioned between said left and right side walls, said grip member including a mounting bracket extending away from an underside thereof; a shaft which extends through said mounting bracket and one of said bearing holes; and an actuating lever connected to said shaft which moves within one of said left and right side channels and which extends downwardly below said floor, said actuating lever rotating when said grip member is rotated relative to said one bearing hole, and a spider member rotatably mounted on said bearing shaft, said spider member including a hub, a plurality of latch arms extending away from said hub, and an operating arm extending away from the hub so as to be in contact with said actuating lever, and a torsion spring having one end in contact with said spider member and an opposite end fixed relative to the pan housing floor, said torsion spring biasing said operating arm of said spider member against said actuating lever of said paddle handle member.

* * * * *